United States Patent [19]

Costello

[11] Patent Number: 4,745,407

[45] Date of Patent: May 17, 1988

[54] MEMORY ORGANIZATION APPARATUS AND METHOD

[75] Inventor: Peter W. Costello, Los Altos, Calif.

[73] Assignee: Sun Microsystems, Inc., Mountain View, Calif.

[21] Appl. No.: 792,795

[22] Filed: Oct. 30, 1985

[51] Int. Cl.[4] ..... G09G 1/16

[52] U.S. Cl. ..... 340/799; 340/798; 340/723

[58] Field of Search ..... 340/798, 799, 703, 750, 340/723

[56] References Cited

U.S. PATENT DOCUMENTS

| | | | |
|---|---|---|---|
| 3,911,418 | 10/1975 | Takeda | 340/703 |
| 4,180,805 | 12/1979 | Burson | 340/799 |
| 4,206,457 | 6/1980 | Weisbecker et al. | 340/799 |
| 4,475,104 | 10/1984 | Shen | 340/703 |
| 4,496,976 | 1/1985 | Swanson et al. | 340/798 |
| 4,509,043 | 4/1985 | Mossaides | 340/703 |
| 4,580,135 | 4/1986 | Kummer et al. | 340/703 |
| 4,667,190 | 5/1987 | Fant | 340/798 |

*Primary Examiner*—Gerald L. Brigance

*Attorney, Agent, or Firm*—Blakely Sokoloff Taylor & Zafman

[57] ABSTRACT

An improved memory organization for use in a computer display system including a display having a plurality of display pixels for defining images that includes: a frame buffer memory having a plurality of memory cells organized into a matrix, said memory comprising first and second maps wherein the contents of the maps correspond to the pixels and define characteristics of the pixels, the maps being defined along X and Z axes of the matric; reading means coupled to the frame buffer memory for selectively reading, in one memory cycle operation, a plurality of bits from memory cells defining one of the maps; writing means coupled to said frame buffer memory for selectively storing, in one memory cycle operation, a plurality of bits into memory cells defining one of the maps; control logic means coupled to the reading means and the writing means for generating control signals for selectively reading a plurality of bits from one of the maps and writing a plurality of bits into one of the maps to define the images to be displayed on said display; wherein multiple maps may be defined in an array of memory cells, each of the maps providing different characteristics for the pixels of the display.

19 Claims, 8 Drawing Sheets

PIXEL MODE AND WORD MODE DATA MULTIPLEXING

MEMORY ORGANIZATION APPARATUS AND METHOD

BACKGROUND OF THE INVENTION

1. Field of the Invention

The present invention relates to the field of computer memories, and more particularly, to improved apparatus and methods for memory organization.

2. Art Background

In computer systems, it is quite common to represent and convey information to a user through images that are digitally generated. These images may take a variety of forms, such as for example, alphanumeric characters, graphs, or pictorial representations of three dimensional objects. In many applications, the digital images are conveyed to a user on a display device, such as a raster scan color cathode ray tube (CRT), printer or the like. Typically, the images to be displayed are stored or generated in a digital form, manipulated, and then displayed.

In raster scan display systems, a CRT is employed which has a plurality of display elements, known as pixels, that are arranged along raster scan lines, as is common in the art. Each pixel is assigned a single bit digital value to represent foreground/background (as in a monochrome display system) or a multiple bit digital value to represent color (as in a color display system). Memories used to store representations of each pixel, compromising an image, are known as "mapped" or "frame buffer" memories.

As is commonly practiced in the art, the frame buffer is a dual-ported memory. A first port is dedicated to display refresh and a second port is dedicated to image updates. The frame buffer memory is typically time-sliced between the two ports, and more recent prior architectures employ a dynamic random access memory (DRAM), for use in video systems termed a "video memory DRAM", as the frame buffer memory which includes a very large serial shift register built into the video memory DRAM. In display refresh, an incrementing address is supplied to the DRAM input and the DRAM output data is first buffered and then serialized using high-speed shift registers. In such prior art architecture using a monochrome (black and white) display system, the frame buffer output data is typically sent directly over a cable to the CRT. In prior art architecture using a color system, the frame buffer output data is typically transmitted through a color look-up table and then to three digital to analog converters to drive a standard red-green-blue color monitor. The second image update port to video memory is coupled to a central processing unit or similar logic that is capable of manipulating and changing the data stored in the frame buffer.

Traditionally, the second update port of the frame buffer has been configured as an X-Y random access memory wherein the frame buffer is organized to have an X-coordinant and a Y-coordinant (one operation sets an X address, a second operation sets a Y address and a third operation reads or writes data space composed of 8-bit, 16-bit, 32-bit or larger width data values). In such prior art systems the processing logic coupled to the frame buffer memory has been a low-level, but relatively fast, microcoded local central processing unit or other similar bus master and the low-level interface to the local host CPU that operates on the frame buffer has been through high-level commands over a relatively slow serial link or direct memory access channel. More recent computer graphics architectures, including that of low-cost microcomputers, have transferred the graphics computational overhead from the serial link onto the host processor (e.g the Intel 80286 or the Motorola MC68020) or onto very large scale integrated chips (e.g NEC 7220), however, such systems have been limited to text operations. In either case, the low-level interface between the update port on the frame buffer memory and the logic providing the high level commands has been that of traditional Von-Nuemann architecture, to wit: linear instruction streams utilizing memory addresses corresponding to well defined memory or data cells.

Computers have traditionally addressed their memories in 8-bit, 16-bit, 32-bit or larger 2**N increments. One memory cycle has the capacity to transfer a predetermined number of bits and, of course, transferring data using the maximum possible data width maximizes performance. Hence, an 8-bit machine is typically inferior to a 16-bit machine and so on. For simplicty in the following descriptions we often try to use the term "byte" whenever possible; the reader should be aware that the mechanisms described may scale wider data paths.

In monochrome systems, the most reasonable method to increase performance is to organize or "map" the frame buffer memory so that a byte (8-bit) quantity will modify 8 adjacent pixels. As mentioned, the entire CRT screen is "mapped" in memory in this fashion and is commonly termed in the art as bit-mapping or "bit-mapped" displays. Bit values of "1" and "0" selectively chose between foreground and background (or vice-versa) in the accessed bit-map. Many recent personal microcomputers use this technique, however, machines traditionally falling under the category of "terminals" use character generators and do not fall in the category of "bit-mapped" displays.

In a memory mapped color system, however, each dot on the cathode ray tube (CRT) has three colors associated with it and each color will have a range of possible intensities. The number of bits typically used to encode the color intensities varies from 4 to 8 to 24 and up. A frame buffer stores these values which serve as indexes for a color look-up RAM. For example, an 8-bit frame buffer color value may index into a 256×24 RAM and a 24-bit output of this RAM may be split to drive three 8-bit red, green, blue, Digital-to-Analog converters. In all, systems that map the CRT screen in memory and which use color, each dot on the CRT is represented by a multiple-bit entity in the frame buffer. Prior art systems have organized memory arrays such that a byte transfer will transfer a particular value representing a particular pixel color to a specific X, Y location in the frame buffer array.

Such color display systems are often required to simultaneously display text or other 1-bit per pixel information and complex graphic images that require color values or other multi-bit per pixel information. However, when one bit per pixel information is required, prior art color systems require, because of their limited addressing architecture, an entire multi-bit data value to be transferred in order to convey 1 bit of information to a pixel. The improved memory organization of the present invention allows a color display system to have all the performance advantages and speed of a monochrome display (i.e. 1 bit of information affecting one pixel), while also being able to support traditional color applications (i.e. 1 multi-bit value affecting one pixel). Thus, a color display system using the improved memory organization of the present invention may operate simultaneously in a monochrome mode and in a traditional color mode. The memory organization of the present invention may be viewed as having a third port to the frame buffer to complement the single update port normally coupled to a frame buffer memory. Ignoring the video refresh port into the frame buffer memory, the traditional Von Nuemann precept of of one set of addresses selecting one set of datum has been modified to cause two sets of addresses to access the same set of data.

The following is a more detailed introductory explication to aid the reader in understanding the concepts introduced in the foregoing description.

For purposes of the specification contained herein, the term "map" or organization, is not restricted to a relationship of one bit stored in memory to one pixel, and is intended to include any set of bits representing a pixel, or other discrete device. Thus, a map or organization as used herein, is intended to include a plurality of bits, or sets of bits stored in memory which conveys one type of information to a pixel or other discrete device. Thus, a memory storing two types of information for a single pixel display may contain two organizations. As mentioned, in a monochrome display, typically, a multi-bit value stored in memory represents background (e.g. black) or foreground (e.g.white) at a corresponding plurality of pixels on a display screen. Each bit of this value having, for example, a logic of 1, would determine a foreground (black) at a corresponding pixel on a CRT, a 16 bit word would determine background or foreground at 16 corresponding pixels. Thus, text operations that require only background or foreground (a logic of 1 or 0) may be sufficiently determined by such a representation.

When color is desired to be displayed on a CRT, more information than a logic of 1 or 0 is needed to represent a color, at a corresponding pixel. In an 8 bit per pixel color system, colors are assigned values from the integers 0 to 255 and are digitally represented and stored in the memory array. When representing color on the display screen, the memory organization storing the color values becomes more complicated because in order to digitally map, in memory, values representing background/foreground at a corresponding plurality of pixels (referred to herein as word values) and a byte representing color at a single coresponding pixel, (referred to herein as "pixel values") in a single memory array, each pixel of the display CRT requires at least eight bits of information to be mapped into a memory array ($2^8=256$) for every pixel value. The present invention permits the organization of this color information into the same memory array used to store the background or foreground information so that text or font displays requiring only background/foreground may also be used, when desired, in addition to displaying color.

In FIG. 1, for purposes of illustration, there is shown a conceptual representation of a portion of such a dually mapped or organized memory array containing two separate sets of information (i.e. pixel color information and background/foreground information) stored in 128 memory cells. The term "memory cell" herein, refers to a digital memory element capable of storing only a single bit. Also, the following description, with reference to FIG. 1, employs the terms X-axis and Z-axis to designate alignment of data bits, however, it will be appreciated by one skilled in the art that these terms are for illustrative purposes and are not intended to restrict the invention to a particular alignment of data within the memory cells of FIG. 1, thus, the X and Z-axes of FIG. 1 are not necessarily orthogonal. Word values are stored in the memory cells of FIG. 1, along the X-axis in a plurality of rows, so that, with reference to FIG. 1, row 1 has stored therein sixteen 0 bits while cell row 2 has stored therein sixteen 1 bits. The bits stored in row 1 could be used to determine background/foreground at 16 adjacent pixels on a CRT screen while the bits stored in row 2 could be used to determine background/foreground at the same 16 adjacent pixels. Thus, the bits stored in rows 1 through 8 comprise eight word values that individually determine the background or foreground at 16 adjacent pixels on a CRT screen. Stored along the Z-axis, of the same memory cells of FIG. 1, are 16 columns, 0–15, that determine a color at the same 16 corresponding pixels on the CRT screen. In memory cell 1 of row 1, the first bit, having a logic of 0, which could be read to determine foreground at a single corresponding pixel, would also contain the first bit of an eight bit pixel byte used to designate a particular color to be displayed at a corresponding pixel on a CRT screen. The bit stored in memory cell 17 of row 2, having a logic of 1, would contain the second bit of an eight bit pixel value. Accordingly, the first left-hand bit of rows 1 through 8 also represent an eight bit color or pixel value that would be used to designate a particular color at a corresponding pixel of a CRT screen. In this fashion both background or foreground values, termed herein "word values" (defining a first organization) and color values, termed herein "pixel values" (defining a second organization) may be dually mapped in the same memory cells.

Traditionally, prior art color systems have employed only a Z-axis aligned addressing technique thus, if such a prior system used the memory organization of FIG. 1, 16 separate read or 16 separate write operations would be required in order to transfer a 16 bit X-aligned value such as the word value stored in row 1, in order to display simple black or white fonts of text. With reference to FIG. 1, in such a prior art system, as each Z-aligned value was transferred, the bits of each word read from or written to the memory array would have to be selected and composited in an adjacent device until, after 16 read or 16 write operations, the 16-bit word value stored in an X-axis aligned row could finally be determined by means of a complicated merge. This prior art process would have serious drawbacks. To obtain a desired 16 bit X-aligned word value 128 bits of Z-aligned byte information would have to be transferred along a bus. Since only sixteen bits of the 128 bits of information transferred comprise the desired 16 bit word value, such a prior art system would be much slower than it might otherwise be. The present invention overcomes the difficulties contained in the prior art by establishing a dually mapped or organized memory array and by addressing that array, in one memory cycle operation, along one coordinate, termed herein a "pixel-mode" and, in another memory cycle operation, along another coordinate termed herein a "word-mode". In the example of FIG. 1, if the pixel value in column 1, representing color at a particular pixel, were desired, in one write or read operation, all eight bits of the Z-axis aligned pixel value could be accessed and transferred. Similarly, if the word value in X-axis aligned row 1 is needed, that word may be transferred in a single read or write operation. In displaying objects on a screen, different pixels may require only word-mode values or only pixel-mode values from memory. The present invention allows greater flexibility, greater speed, and superior efficiency in transferring information stored in a digital memory and thus displaying that information on a display screen or other output receiving device.

For purposes of illustration, with reference to FIG. 1, we have termed the pixel bytes of columns 0–15 as being stored within a plurality of Z-axis aligned memory cells, however, since each pixel byte represents a color organized within memory so that it is mapped to a particular pixel on a CRT screen, the pixel values, stored in memory, form a matrix extending depthwise along the Z-axis, as is common the art. The present invention permits the word or X-aligned values,to be organized as a matrix forming a plurality a planes, as shown in FIG. 2, each plane representing the surface of a CRT screen. The word values of each plane as in FIG. 1, are stored in rows along an X-axis, however the pixel bytes extend depthwise into the word planes, along a Z-axis as shown in FIG. 3. Thus, the present invention establishes a 3-dimensional matrix of memory and provides data transfers to efficiently occur within this matrix.

SUMMARY OF THE INVENTION

The present invention provides an improved memory organization that permits access to digital values stored in X-axis aligned rows of memory cells and digital values stored in Z-axis aligned columns of memory cells, such that a memory containing two bit-organizations or maps, utilizing the same memory cells for both of the bit-oganizations or maps, and which are mapped as X-aligned values and as Z-aligned values, may be addressed and thus accessed, in one memory cycle operation. Accordingly, the present invention relates to an apparatus and method for an improved memory organization for storing data representing at least 2 bit-organizations or maps, wherein the bit organizations or maps define images to be displayed on a Cathode Ray Tube (CRT) screen. The CRT includes a plurality of pixels wherein selective addressing schemes determine information conveyed to the pixels, such that the images are thereby defined on the CRT and wherein each of the memory cells contain a logic value that simultaneously represents a bit addressable in one manner and a bit addressable in another manner. The improved memory organization includes a frame-buffer memory for storing the bit-organizations or maps, and a first means for organizing the data such that a first bit-orgaization or map is defined within the frame-buffer. The first bit-organization or map comprises a first plurality of digital values which are stored in memory cells within the frame buffer, and are aligned in rows along an X-axis. The improved memory organization also includes a second means for organizing the data, such that a second bit-organization or map is represented within the frame-buffer, the second bit-organization or map comprises a second plurality of bytes. The second plurality of bytes are stored in memory cells within the frame buffer, and are aligned in columns along a Z-axis. The first means for organizing and the second means for organizing collectively comprise a control logic means for reading a plurality of bits from the first bit-organization or map in one read operation, and a plurality of bits from the second bit-organization or map in one read operation, and for writing a plurality of bits into the first bit organization or map in one write operation and a plurality of bits into the second bit-organization or map in one write operation. The present invention provides bit organizations or maps stored in memory which forms a 3-dimensional matrix of X-aligned values and Z-aligned values such that the X-aligned values are organized to form a plurality of planes, (each plane a representing CRT screen), and wherein the planes are consecutively aligned along the Z-axis. Mapped into the same frame buffer memory matrix there also exists a sequence of Z-aligned values which are values addressed in a different manner. Accordingly, one memory cell in the frame buffer can be addressed as part of either an X-aligned "value" or a Z-aligned "value", so that in one memory cycle operation, an entire Z-aligned value may be transferred and, in another memory cycle operation, an entire X-aligned value may be transferred.

DETAILED DESCRIPTION OF THE INVENTION

An improved computer memory organization is disclosed having particular application for use with a digital computer to provide high speed transfer of data necessary to display graphics on a CRT screen. In the following description for purposes of explanation, numerous details are set forth such as specific memory sizes, data paths, etc., in order to provide a thorough understanding of the present invention. However, it will be apparent to one skilled in the art that these specific details are not required to practice the present invention. In other instances, well known electrical structures and circuits are shown in block diagram form in order not to obscure the present invention unnecessarily. It will also be appreciated by one skilled in the art that the improved memory organization of the present invention may be used in systems other than graphics systems.

Figure 1:
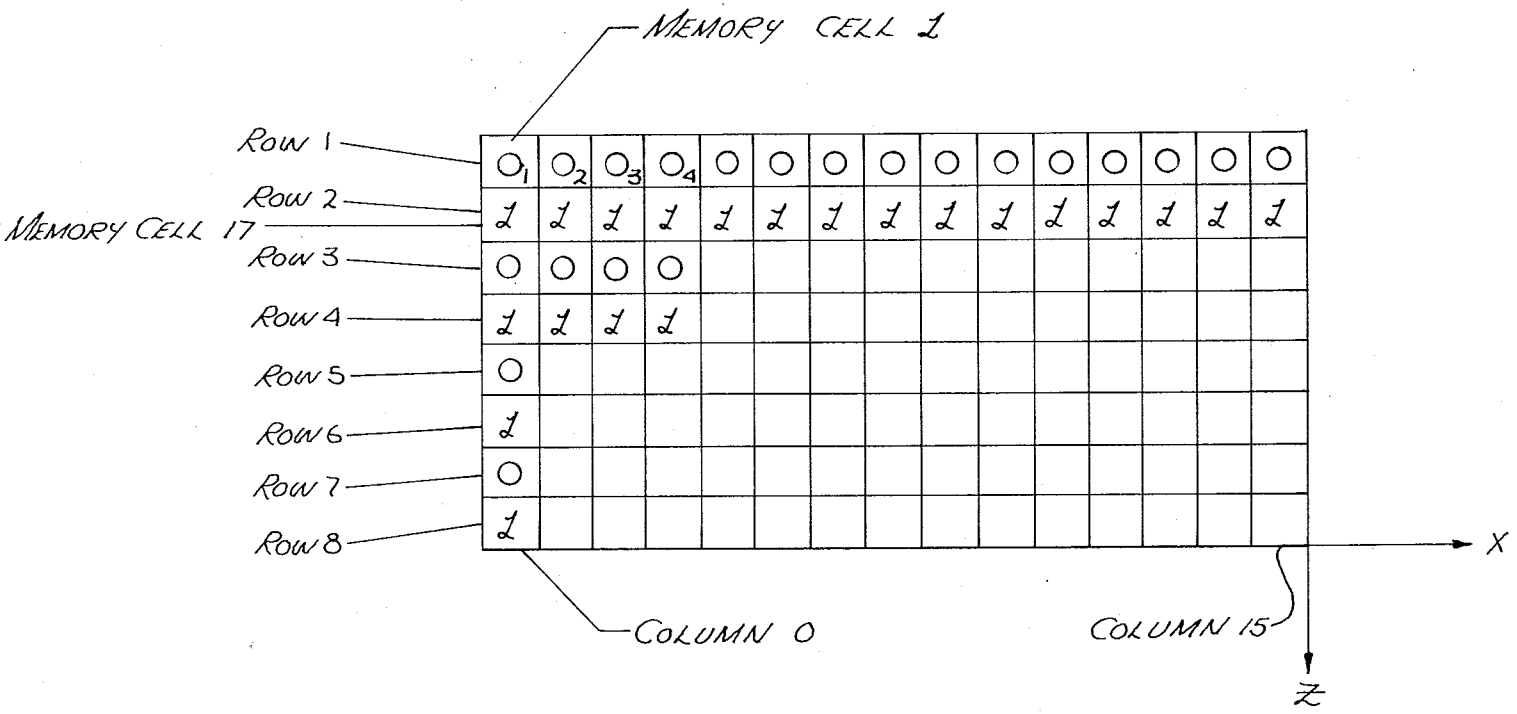
FIG. 1 is a conceptual illustration of 128 memory cells of a memory array.

FIG. 1 conceptually illustrates a single two-dimensional eight by sixteen block of memory cells. In a standard memory, there are many thousands of such blocks. It would be advantageous if the blocks could be organized as a three-dimensional matrix having dimensions that would correspond physically to a color CRT screen. The present invention has discovered a unique addressing technique that organizes a two-dimensional memory into a three-dimensional matrix which is mapped in the memory to more closely correspond to a CRT screen.

Figure 2:
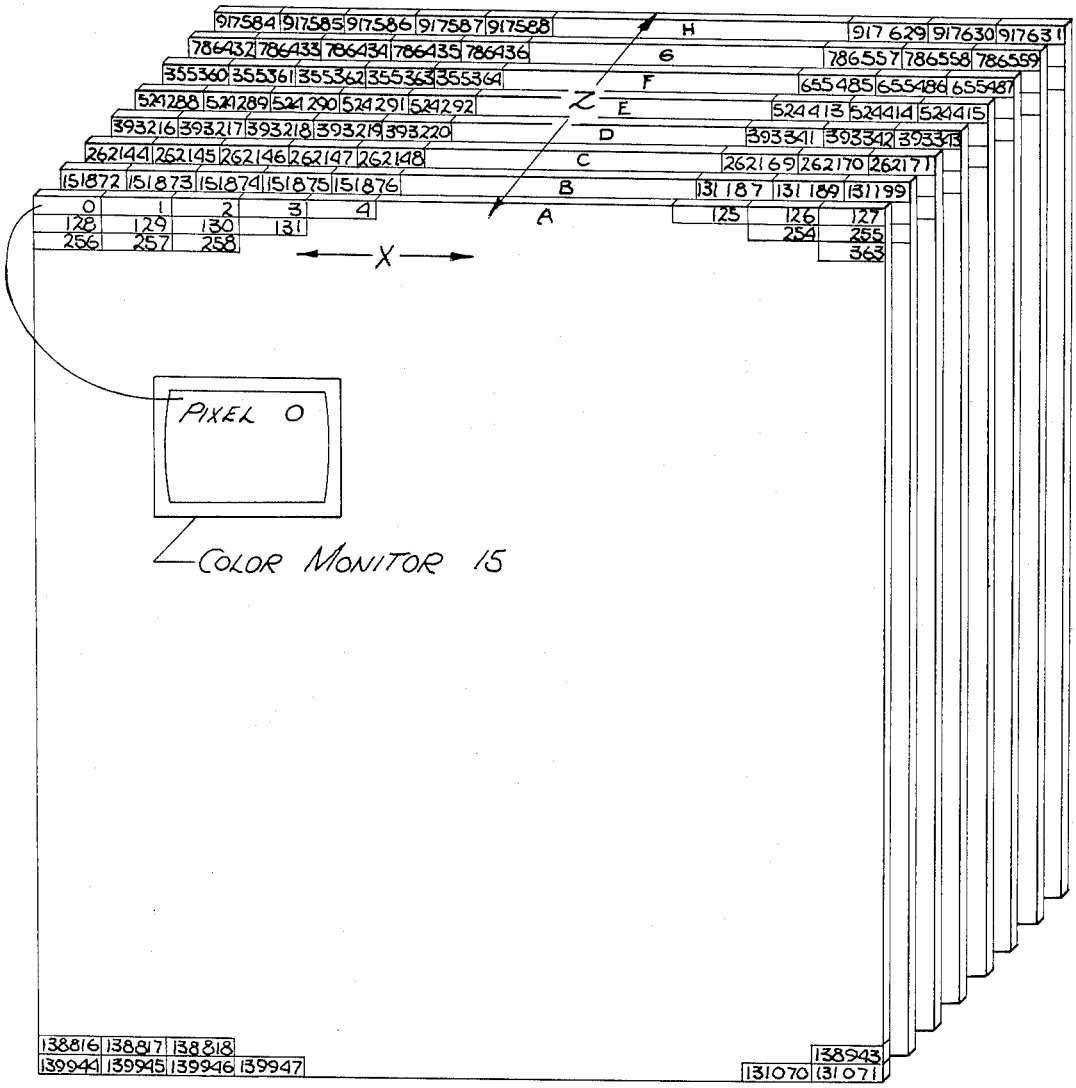
FIG. 2 illustrates the correspondence of word-mode addresses to 8-bit byte locations in a frame buffer memory.

The word-mode organization (addressing) of the present invention is illustrated in FIG. 2, wherein there is shown 8 word-planes (A–H). Each word plane represents a map of a CRT screen and is one bit deep. Since there are 1,024 pixels in a typical single scan line and 1,024 scan lines in a typical graphics display color CRT, approximately one million bits (or 128K bytes) are required for each word plane in the frame buffer memory. Accordingly, approximately one million X-aligned bytes are stored on the eight word planes A–H. In the herein described embodiment, the dimensions of each word plane are 1,024 bits by 1,024 bits. Thus, the first bit of word value number 0 of word plane A, in FIG. 2, determines whether or not pixel number 0 in color CRT monitor 45 will have a background or foreground display. As shown in FIG. 2, there are eight stacked word planes designated A through H. Since there are multiple planes, (each plane being one bit deep), a multiple bit pixel value is also stored in the bits aligned along the Z axis, which, in the present example, is eight bits deep. Thus, one bit from each of 8 vertically aligned word bytes form a single 8-bit Z-aligned pixel value. It will be appreciated that other implementations of the present invention may support larger bits per pixel representations without deviating from the concepts embodied in the present invention.

Figure 3:
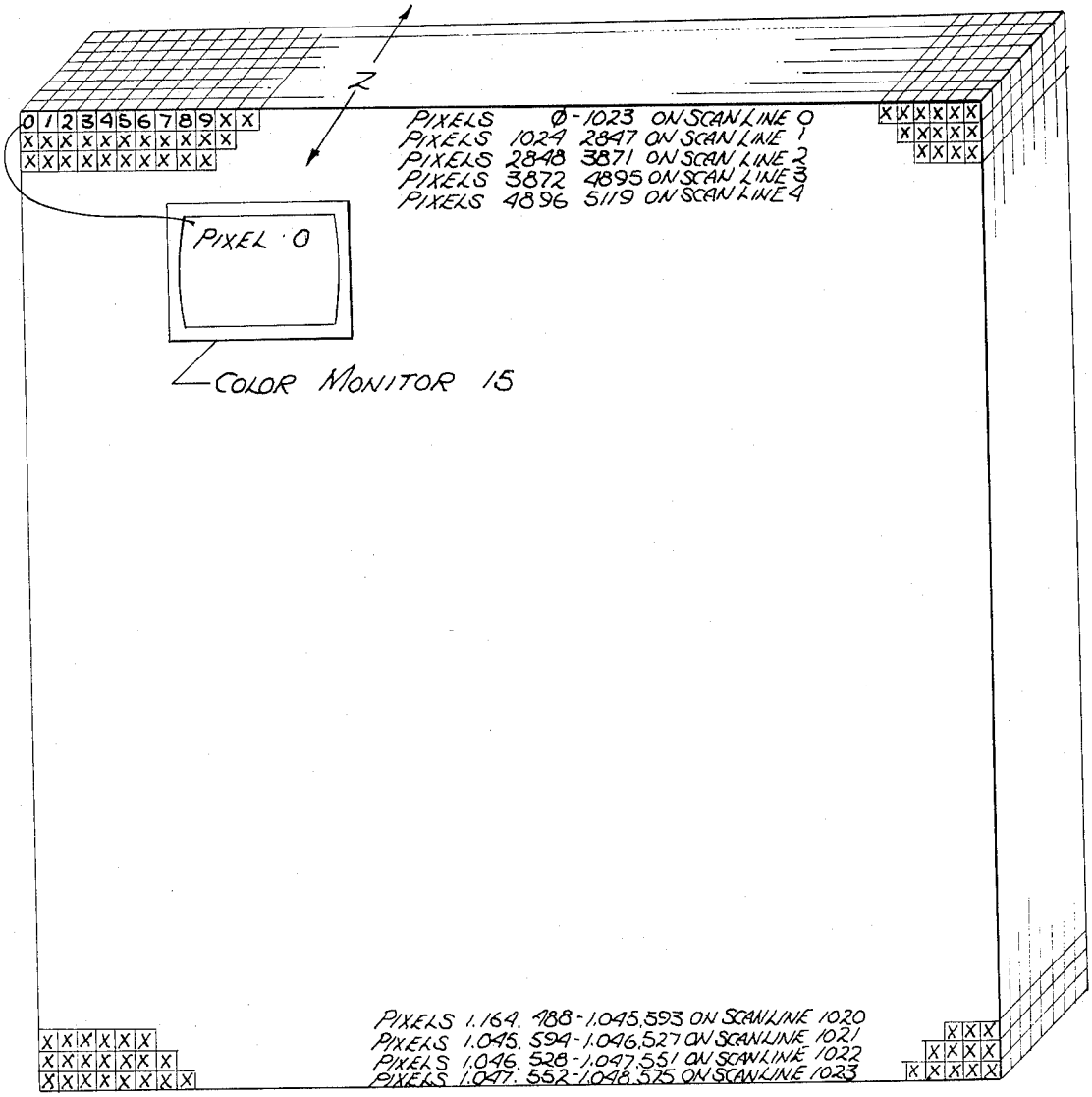
FIG. 3 illustrates the correspondence of pixel-mode addresses to 8-bit byte locations in a frame buffer memory.

Pixel mode organization (addressing) is illustrated in FIG. 3. The block shown in FIG. 3 conceptually illustrates the same 8 word planes shown in FIG. 2, however, since we are concerned now with only Z-aligned pixel bytes, the pixel bytes stored along the Z-axis are accurately represented as a matrix forming a solid box, wherein the pixel information is contained depth-wise along the Z-axis. In the present embodiment, each eight bit bytes organized along the Z axis, as shown in FIG. 3, determines a particular color at a corresponding pixel on color monitor 15. Thus, pixel byte 0 in FIG. 3, determines the color displayed at pixel number 0 in color monitor 45. Accordingly, these organizations shown in FIGS. 2 and 3 are representations of the bit-organization or maps dually stored in the same memory cells wherein the 3 dimensional representation of the memory cells corresponds to the display monitor 15, such that each surface of each of the eight word planes corresponds to the screen of the monitor 15 and the Z axis of the memory array corresponds to changes in color and intensity for each pixel on the screen of color monitor 15.

The present invention provides a unique addressing scheme such that when an X-aligned byte stored in word planes A-H of FIG. 2 is desired, it may be transferred in one memory cycle operation (i.e. write or read) and similarly, when a Z-aligned byte is desired, it may also be transferred in one memory cycle operation.

Thus, the present invention establishes a 3-dimensional matrix of memory and provides data transfers to efficiently occur within this matrix. The following is a detailed description of the architecture used to create such a three-dimensional memory organization, however, it will be remembered that the foregoing description is only one possible embodiment of the present invention for purposes of illustration only and other embodiments may use wider data-bus widths and larger memories. It will also be appreciated that the X and Z coordinates illustrated in FIGS. 2 and 3 do not necessarily imply orthogonal coordinates.

Figure 4:
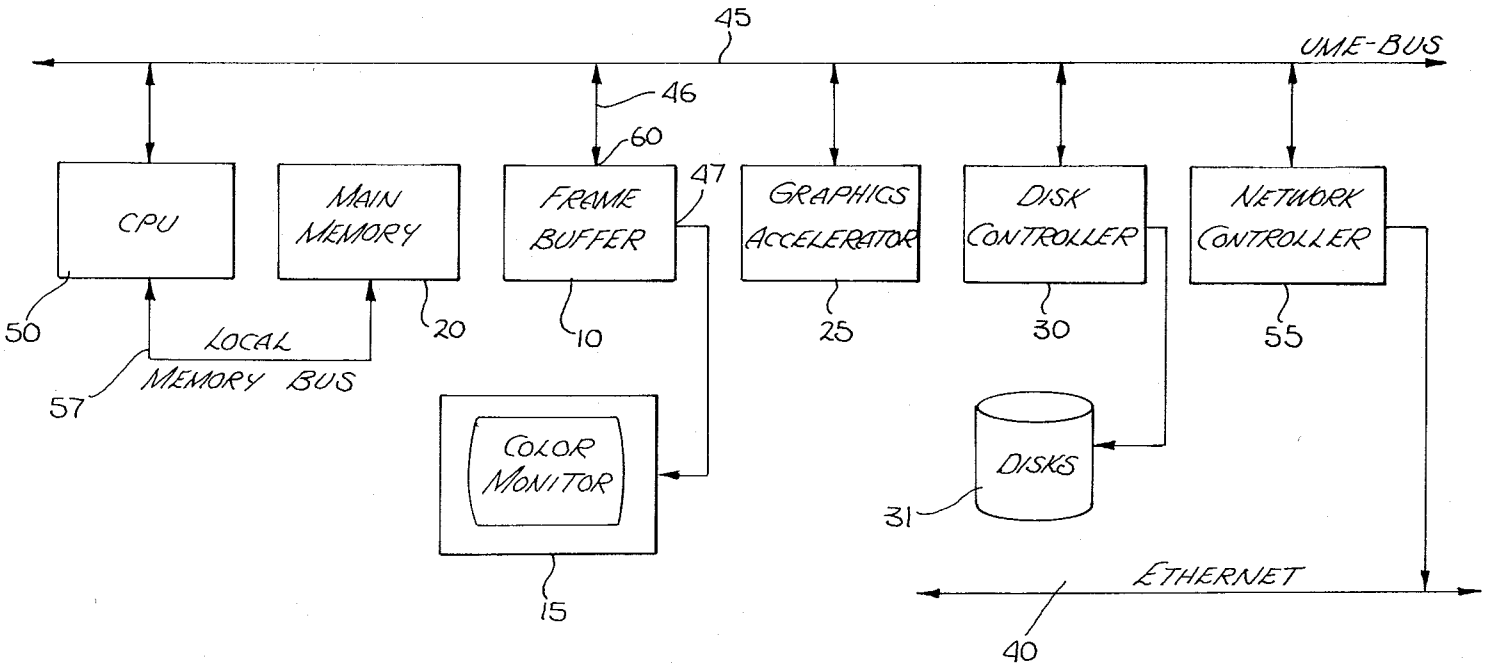
FIG. 4 is a functional block diagram of the improved memory organization implemented in a graphics display system.

In FIG. 4, there is shown an overall block diagram of the improved memory organization system. Data is transferred over a (VME) bus 45 is coupled to frame buffer bus 46 which is coupled to the first port 60 of a dual ported frame buffer memory 10, to permit data transfers between the VME bus 45 and the frame buffer 10. The second port 47 of the frame buffer 10 outputs data that ultimately yields a desired image on color monitor 15. The first port 60 of the frame buffer memory is used for either word-mode or pixel-mode data transfers. Any VME bus master device (i.e. a CPU) can write to or read from frame buffer 10 over the VME bus 45. The most common bus master devices used to access the frame buffer 10, in order of frequency used are a local CPU 50 graphics accelerator 25, network controller 55, or a disk controller 30 using storage disks 31. In the embodiment described, the main memory 20 is coupled to CPU 50 by a local bus 57 and contains information utilized by the CPU 50. In the described embodiment, the CPU 50 initiates commands which ultimately write or read data stored in frame buffer memory 10 to yield a desired image on monitor 15. In a typical configuration of the present invention, a work station consists of an enclosure containing a VME back plane (hardware implementing VME bus 45), a host system CPU 50, a main memory 20, a frame buffer memory 10, and network controller 55. As will be appreciated, graphics accelerator 25 and local disk interface 30 and 31 can be used with the system, however, they are not required because mass storage requirements can be provided by another machine connected over the ETHERNET 40, by network controller 55. The frame buffer 10 is a memory device comprised of dynamic random-access memory chips (DRAM).

Figure 5:
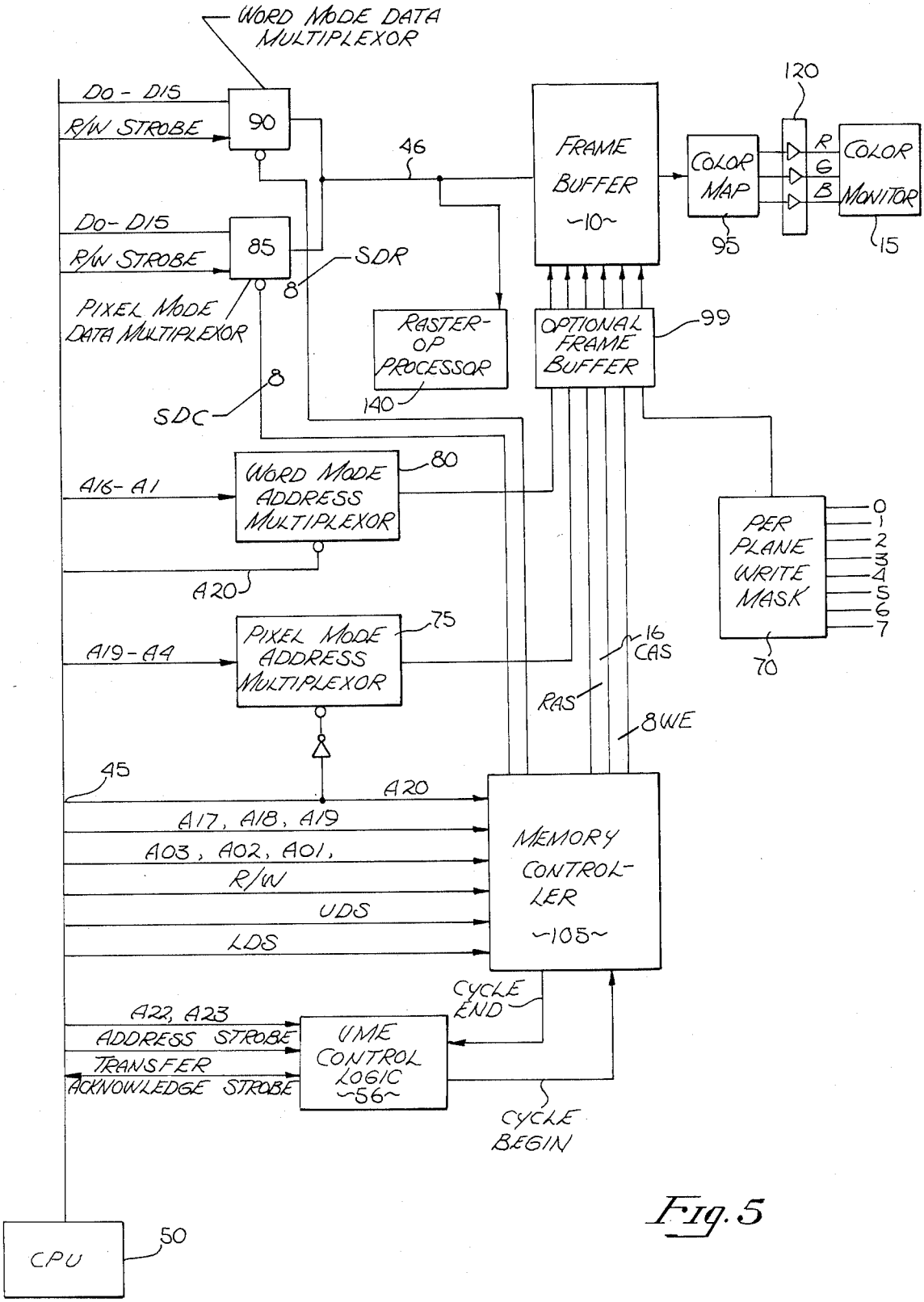
FIG. 5 is a functional block diagram of the improved memory organization architecture.

In FIG. 5, there is shown a more detailed functional block diagram of the memory organizing architecture of the present invention. VME bus 45 carries physical addresses ranging from 0 to 16 megabytes. Also transferred on the VME bus 45 is data which represents a pixel-mode value or a word-mode value. The VME bus 45, in the present embodiment, transfers 16 data bits and 24 address bits in one operation. The local CPU 50 issues the 24 address bits and the 16 data bits. Address bits A22 and A23 (in hexadecimal), together with an address strobe, are transmitted from the CPU 50 along the VME bus 45 to VME control logic 56. A preset value on Address bits A22 and A23 in conjunction with the address strobe initiate a cycle-begin strobe at the output of the VME control logic 56. The cycle-begin strobe is transmitted to memory controller 105 which then initiates a memory cycle operation at frame buffer 10. The cycle begin strobe also initiates at memory controller 105 a Row Address Strobe (RAS), which will later be discussed. At the end of a memory cycle operation, memory controller 105 transmits a cycle-end strobe to VME control logic 56. VME control logic 56 then initiates a transfer acknowledge strobe which is transmitted along VME bus 45 to the CPU 50 to convey to the CPU 50 that a memory cycle has been completed and that a new memory cycle may begin.

Memory Controller 105 also issues several control strobes to frame buffer 10 and data multiplexors (or drivers) 90 and 85. In order to fully understand the operation of these strobes on data multiplexors 90 and 85 and frame buffer 10, reference is now also made to FIGS. 6(*a*), 6(*b*) and 6(*c*) in addition to FIG. 5.

Figure 6A:
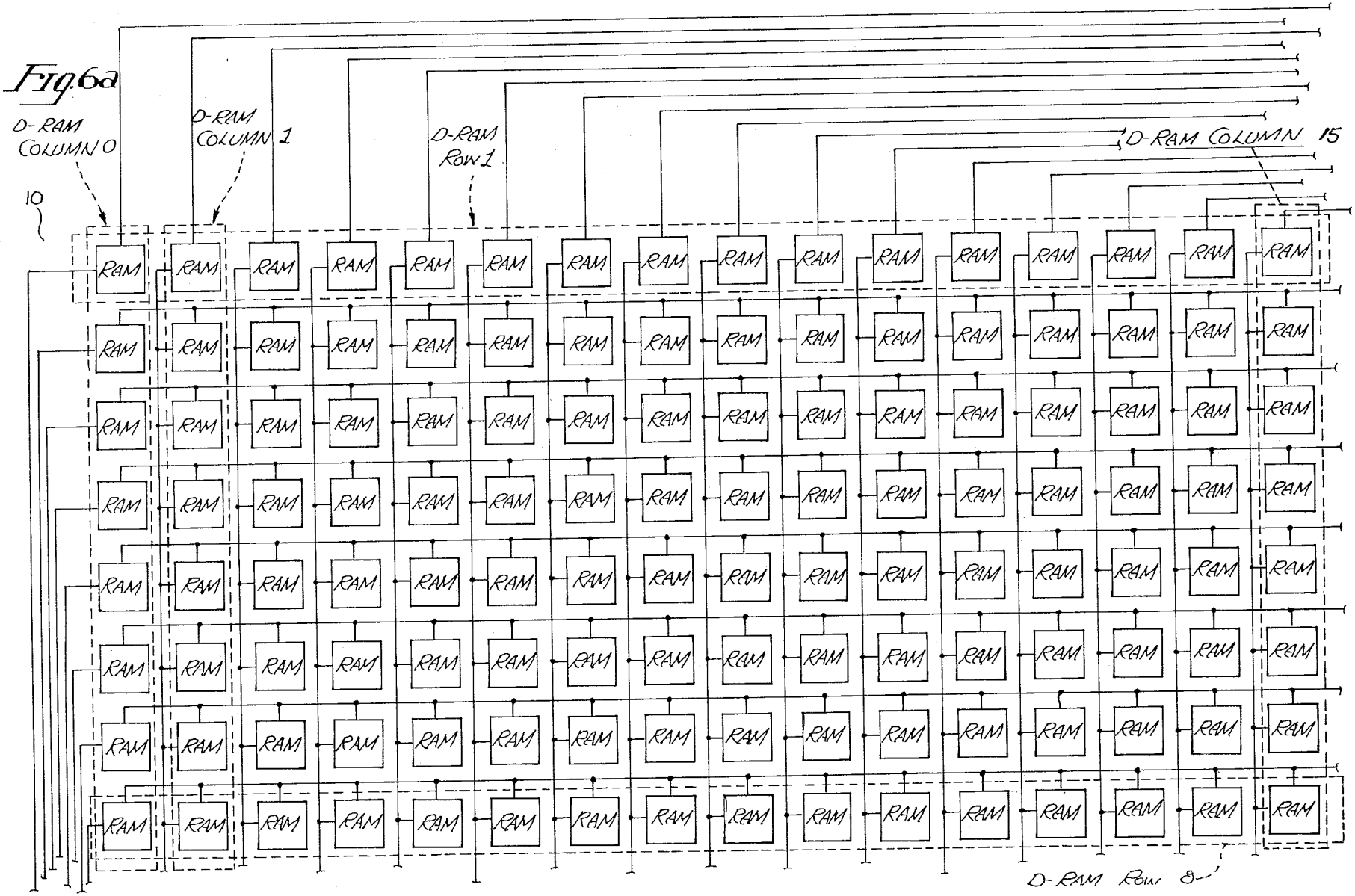
FIGS. 6(*a*), 6(*b*), and 6(*c*) are circuit diagrams of pixel-mode and word-mode data multiplexors and a frame buffer memory array.
Figure 6B:
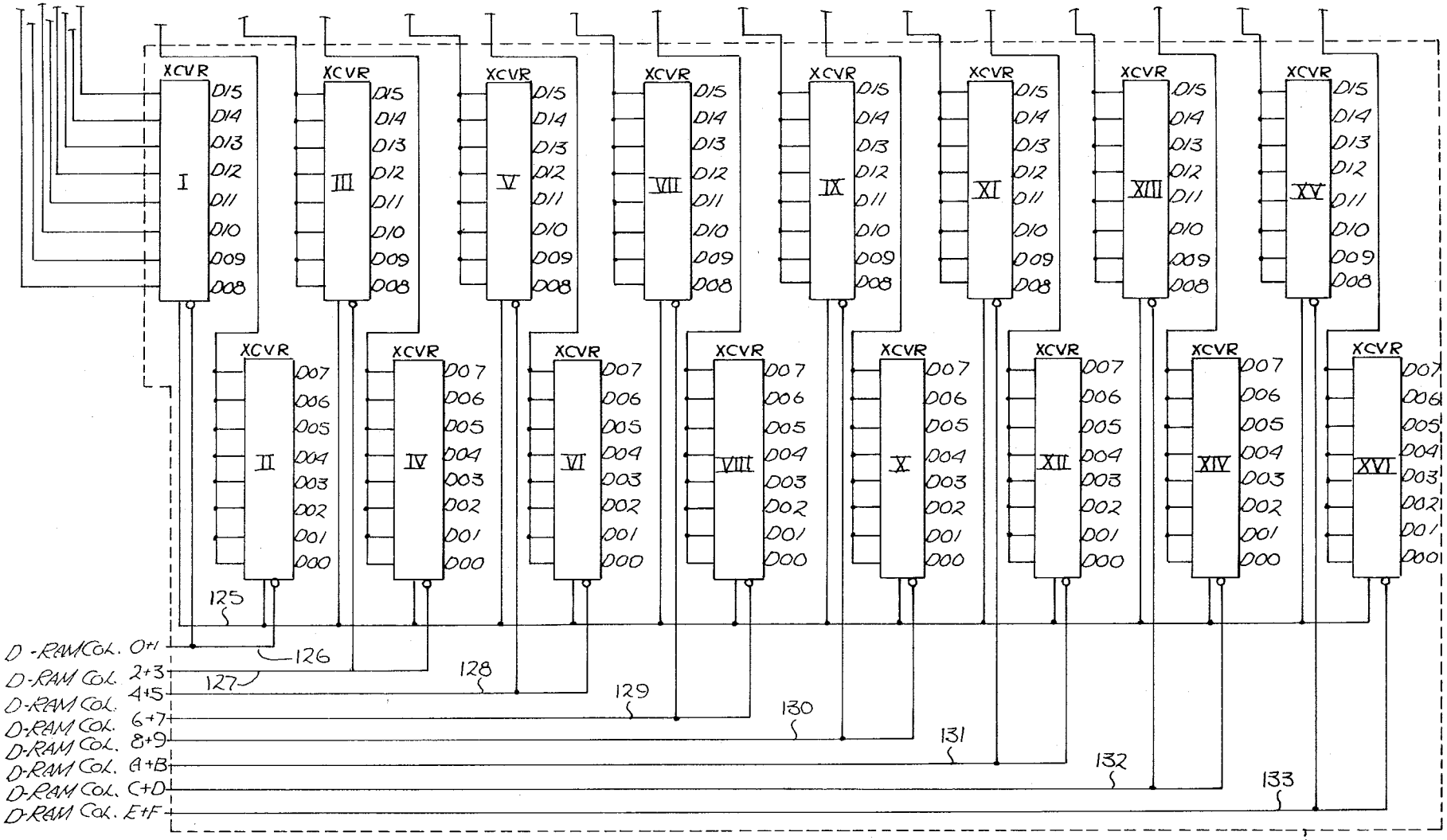
Figure 6C:
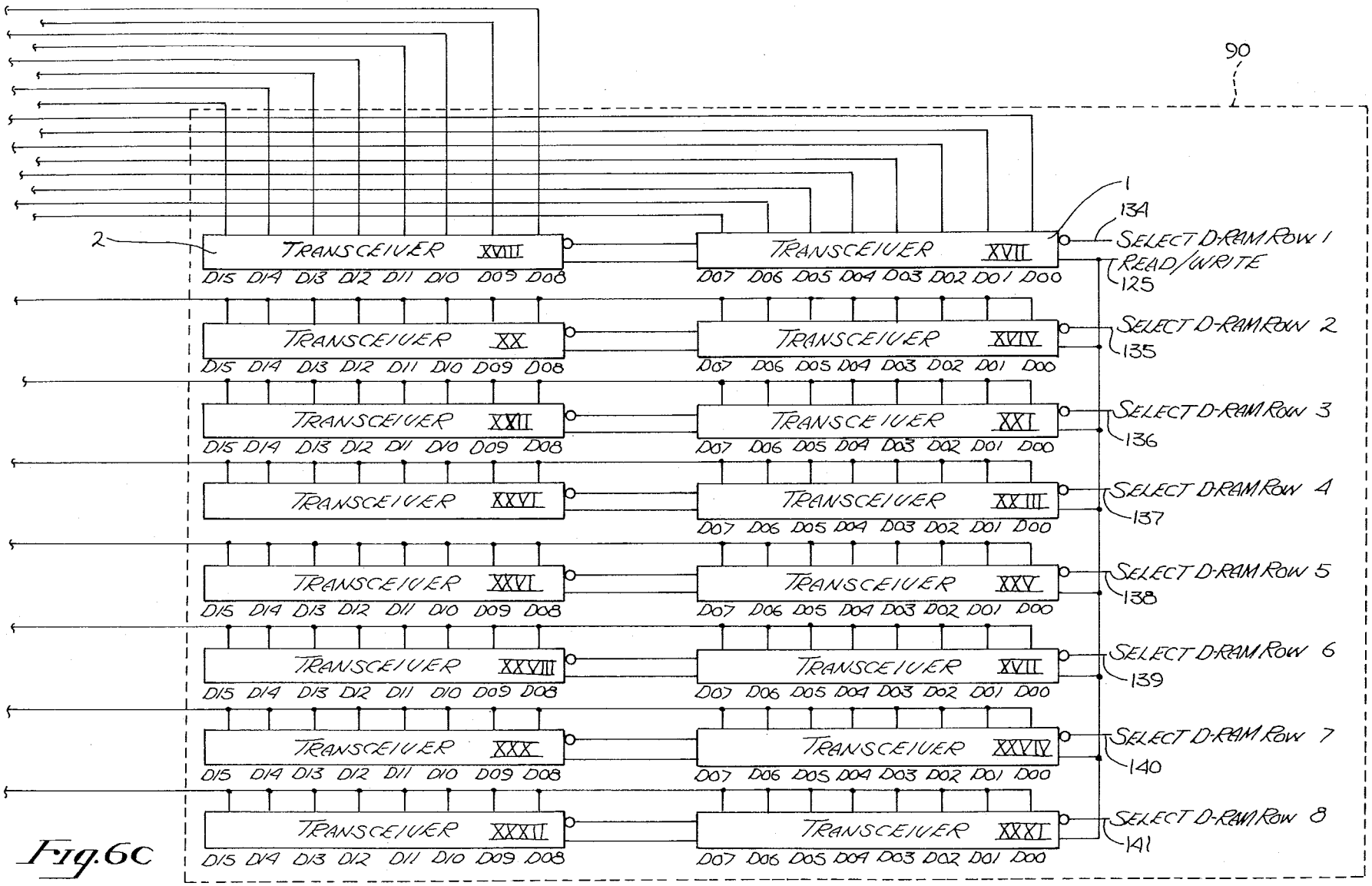

In FIGS. 6(*a*), 6(*b*) and 6(*c*), there is shown a detailed illustration of the pixel-mode data multiplexor 85, the word-mode data multiplexor 90 and frame buffer 10 circuitry. In FIG. 6(*a*) there is shown the frame buffer memory 10 having 128 64K DRAM chips, while FIG. 6(*b*) shows the pixel-mode data multiplexor 85 having a first set of 16 transceivers (I-XVI) and FIG. 6(*c*) shows word-mode data multiplexor 90 having a second set of 16 transceivers (XVII–XXXII). The transceivers of FIG. 6(*b*) and 6(*c*) may comprise octal-ICs, for example, the generic 74ALS245 Texas Instruments IC. These transceivers transfer data from the frame buffer memory 10 to the VME bus 45 or from the VME bus 45 to the frame buffer memory 10. The read/write (R/W) control line 125 is connected to the transceivers of the pixel-mode data multiplexor 85 and the transceivers of word-mode data multiplexor 90. R/W control line 125 receives a read or a write control signal issued by CPU 50 along VME bus 45 which controls the direction of data transfers of the word-mode data multiplexor 90 transceivers (XVII–XXXII), and the pixel-mode data multiplexor 85 transceivers (I–XVI). The pixel-mode data multiplexor 85 transceivers are enabled when an address bit A20 has a logic of high and the word-mode data multiplexor 90 transceivers are enabled when address bit, A20, has a logic low.

In the described embodiment, frame buffer 10 is constructed as shown in FIG. 6(*a*) having 128 64K DRAM chips arranged so that eight rows [each row having 16 DRAM chips, e.g. DRAM row 1 and DRAM row 8 of FIG. 6(*a*)] and 16 columns [each column having eight DRAM chips, e.g. DRAM columns 0 and 15 of FIG. 6(*a*)] are formed therein. In the described embodiment, frame buffer 10 has a storage capacity of approximately one megabyte, however, it will be appreciated that memories having larger or smaller storage capacities may also be used and that the present invention may be accordingly scaled.

Selective reading and writing of specific DRAM chip columns and DRAM chip rows of the frame buffer 10 which provide the memory organizations of FIGS. 2 and 3 and which permit, in one memory cycle operation, the transfer of an X-aligned word value or a Z-aligned pixel (color) value is accomplished through the selective transmission of; 16 Column-Address-Strobes (CAS), 8 Write-Enable Strobes (WE) to the frame buffer memory 10, 8 select DRAM column enabling signals (SDC) to the pixel-mode data multiplexor 85, 8 select DRAM row enabling signals (SDR) to the word-mode data multiplexor 90, all of which are transmitted by memory controller 105, and the physical addresses, transmitted, respectively, by word-mode address multiplexor 80 and pixel-mode address multiplexor 75. The SDC signals serve the purpose of selectively enabling the pixel-mode transceivers I–XVI of pixel-mode data multiplexor 85, while, the SDR signals serve the purpose of selectively enabling the word-mode transceivers XVII–XXXII of word-mode multiplexor 90. The purpose of the RAS and the CAS are well known in the art and thus no further discussion of their purpose is necessary. Preset values of address bits A1, A2, A3 and two data strobes (an Upper Data Strobe and a Lower Data Strobe) selectively enable the transmission of desired CAS signals at memory controller 105 while preset values of address bits A17, A18 and A19 selectively enable memory controller 105 to transmit desired WE signals. Preset values of address bits Al, A2, and A3 also selectively enable the transmission of one or all 8 the SDC signals while address bits A17, A18 and A19 selectively enable transmission of one or all of the SDR signals. All 128 DRAM chips of frame buffer 10 receive a Row Address Strobe (RAS), transmitted from the memory controller 105 on both a read and a write operation. The RAS signals are issued when memory controller 105 receives the cycle begin strobe transmitted thereto from VME control logic 56, as previously discussed.

Word-mode transfers are enabled when address bit A20 is low and pixel-mode transfers are enabled when address bit A20 high. The following is a description of a word-mode read operation. On a word-mode read operation, all 128 DRAM chips of frame buffer 10 receive RAS and CAS signals. In the embodiment described herein, the frame buffer bus 46 is 128 data bits wide, while, as mentioned, VME bus 45 is only 16 data bits wide. Thus, only two transceivers of the 16 word-mode data transceivers (XVII–XXXII) of word-mode data multiplexor 85 are enabled at a time by one of the eight (SDR) signals issued by memory controller 105. A desired one of the eight SDR signals is determined as mentioned, by a preset value of address bits A17, A18, and A19 which are issued by CPU 50 onto VME bus 45 and transmitted to memory controller 105. The two transceivers enabled by one SDR signal effectively multiplex the 128 bit frame buffer read data from 128-bits wide on frame buffer bus 46 to 16-bits wide on VME bus 45. For example, with reference to FIG. 6(*c*), when a read control signal is transmitted on R/W line 125 and received at word-mode transceiver I and word-mode transceiver II concurrent with a one of the select DRAM row signals (SDR), transmitted on transceiver line 134, data bits D15–D08 are transferred from the first eight DRAM chips of DRAM row 1 (going from left to right) while data bits D07 to D0 are transferred to the next eight DRAM chips of DRAM row 1. In this fashion, two 8-bit word values are transferred in one read operation. The remaining word-mode transceivers XVIII–XXXII operate in the same fashion when corresponding transceiver lines (135–141) receive respective SDR signals (issued by memory controller 105 as previously discussed), thereby enabling word-mode transceivers XVIII–XXXII, respectively.

The following is a description of word-mode write operations. On a word-mode write operation, a write signal is asserted on read/write line 125 and all word-mode data transceivers, XVII–XXXII (of word-mode data multiplexor 90), of FIG. 6(*c*) are enabled by assertion, on transceiver lines 134–141 at transceivers XVII–XXXII, of all eight of the SDR signals, (issued from memory controller 105 and determined by a preset value of address bits A17, A18, and A19), to frame buffer 10. In this fashion the 16-bits of data sent by CPU 50, on VME bus 45 data lines D15–D00 are then duplicated by these transceivers and transmitted to each DRAM row in frame buffer 10. Also, as mentioned, on a write operation, all DRAM chips receive a RAS. Approximately concurrently with these signals CPU 50 sends address bits A19, A18 and A17 which also enable memory controller logic 105 to output one of the 8 write enable strobes (WE) to a desired one of the eight DRAM chip rows of FIG. 6(*a*) so that only that row of DRAM chips will be written to. CPU 50 also transmits two data strobes [a Lower Data Strobe (LDS) and an Upper Data Strobe (UDS)] to memory controller 105 which together encode the value of a non-existent address bit (A0) and select 8-bit or 16-bit memory cycles transfers. Thus, if UDS is asserted at memory controller 105, a first 8 data bits will be transferred from VME data bit lines D15–D08 to the DRAM chips of frame buffer 10 and if the lower data strobe (LDS) is asserted, a second 8 bits of data will be transferred from VME data bit lines D07–D00 to the DRAM chips of frame buffer 10. In the present embodiment, data bit D15 is the most significant bit and data bit D00 is the least significant bit. When UDS is asserted, at memory controller 105, a first 8 of the 16 CAS signals will be transmitted to DRAM columns 0 to 7 (counting from left to right) and if LDS is asserted, at memory controller 105 a second 8 of the 16 CAS signals will be transmitted to DRAM columns 8 to 15 (counting from left to right) however only the DRAM chips that receive both a CAS strobe and a WE strobe will be written to.

The following is a description of a pixel-mode read operation. On a pixel-mode read operation, similar to word-mode reads, all DRAM chips of FIG. 6(*b*) receive RAS and CAS signals. The memory controller 105 also asserts one of the eight select DRAM column (SDC) signals which enable two of the 16 pixel-mode data multiplexor 85 transceivers (I–XVI) of FIG. 6(*b*) thereby multiplexing and transferring at an 8:1 ratio 16-bits of data at a time from the 128-bit frame buffer memory bus 46 onto the VME BUS 45 on VME bus data lines D15–D00.

For example, when a read signal is received on the read/write control line 125 concurrent with one of the eight select DRAM column signals (SDC) (as determined by a preset value of address bits A1, A2, A3 at memory control 105) at transceiver line 126, pixel-mode transceiver I of FIG. 6(*b*) transfers data bits D15 to D08 from the DRAM chips of DRAM of DRAM column 0 while pixel-mode transceiver II transfers data bits D07 to D00 from the DRAM chips of DRAM chip column 1. Data bits D15 to D08 represent an eight bit pixel byte while D07 to D00, similarly represent another eight bit pixel byte. In this fashion, two eight bit pixel bytes may be transferred in one operation.

The remaining pixel-mode transceivers (III–XVI) are enabled in the same fashion when corresponding transceiver lines (127–133) receive respective SDC signals (issued by memory controller 105), thereby enabling pixel-mode transceivers III–XVI, respectively.

The following is a description of a pixel-mode write operation. On a pixel-mode write operation, all pixel-mode data transceivers I–XVI, of pixel-mode multiplexor 85 are enabled by the transmission of all eight of the (SDC) signals issued from memory controller 105. Data bits D15–D08, placed on VME bus 45 by CPU 50, are transmitted through pixel-mode transceivers I–XVI to the even DRAM chip columns (counting left to right) 0,2,4,6,8,10,12,14 of the frame buffer 10. The data bits D07–D00, placed on VME bus 45 by CPU 50, are similarly transmitted to the odd DRAM chip columns (counting left to right) 1,3,5,7,9,11,13,15 of the frame buffer 10. As with the word-mode write cycles, all DRAM chips receive a RAS. However, unlike word-mode write cycles, all eight write enable strobes (WE) are transmitted from memory controller 105 to all DRAM chips of frame buffer 10, while only one or two of the sixteen oolumn address strobes (CAS) are transmitted from same. The SDR signals as selectively issued by memory control logic 105 are determined by the values of address bits A1, A2 and A3. Address bits A03, A02, A0l and data strobes LDS and UDS are placed on the VME bus 45 by CPU 50 and received at memory control logic 105 which, as mentioned, enable the transmission of one or two desired CAS signals to the frame buffer 10 during a write cycle. Two of the sixteen CAS signals are transmitted by memory controller 105 to frame buffer 10 when both UDS and LDS are asserted together at memory controller 105 and only one CAS signal is transmitted when either UDS or LDS is asserted at same. As in word-mode write operations only the DRAM chip columns that receive a CAS and a WE are written to. Further, either UDS or LDS must be present at memory controller 105 before a memory cycle operation will begin.

In conjunction with pixel-mode read or write operations, address bits A19–A4, placed on VME bus 45 by CPU 50, are received at the pixel-mode address multiplexor (or driver) 75. When address bit A20 has a logic of high, the pixel-mode address multiplexor 75 transmits the address (determined by the logic values of address bits A19–A4) to the frame buffer 10 and in conjunction with one or two of the 16 CAS issued by memory controller 105, selects a Z-aligned pixel byte location within frame buffer 10, which, in turn, corresponds to a pixel on color monitor 15. The data stored in that memory location contains a color value for a corresponding pixel on color monitor 15.

Similarly, in conjunction with a word-mode read or write operation, address bits A16–A1 are received at word-mode address multiplexor 80 which, when address bit A20 has a logic of low, transmits an address to the frame buffer 10, that, in conjunction with a one of the 8 WE strobes issued by memory controller 105, selects an X-aligned word value location within frame buffer 10 that will, in turn, determine foreground/background at several corresponding pixels on color monitor 15.

The output of the frame buffer 10 is coupled to a color map 95 which determines a color that corresponds to a pixel byte outputted by frame buffer 10 and drives digital to analog red, green and blue color driver/converters 120 to define a particular color at a desired pixel in monitor 15. Also, an optional frame buffer memory 99 may be integrated into the system as shown in FIG. 5. The optional frame buffer memory 99 is organized (addressed) in the same manner as frame buffer 99. A toggle may be employed so that the optional frame buffer 99 may be written to while the frame buffer 10 is being read or the reverse thereof. A "Raster-OP" or "Bit-Blt" processor 140 may also be coupled between the outputs of the word-mode data multiplexor 90, the pixel-mode data multiplexor 85 and the frame buffer memory 10 as shown in FIG. 5. A "Raster-OP" or "Bit-BLT" is known in the art of computer graphics and is currently marketed by VLSI Technology, 1109 McKay Drive, San Jose, Calif. 95131, as "VL16160". Raster-OP processors are also fully discussed in "Principles of Interactive Computer Graphics" by Newman & Sproull. Copyright 1979, 1973. Publisher: McGraw-Hill, Inc. The Raster-OP 140 performs Boolean operations such as "OR"/"XOR" operations on the frame buffer 10 or optional frame buffer 99 contents between the old and new data and thereby may initiate several write or read operations to the frame buffer 10 or optional frame buffer 99 in response to one command cycle initiated by the CPU 50. The Raster-Op Processor 140 operates on data 128 bits wide and may be used to broadcast pixel data to 16 adjacent pixel byte locations of frame buffer 10 or may be used to broadcast 16 X-aligned bytes to all word planes of the word planes shown in FIG. 2 and stored in frame buffer 10.

When writing pixels bytes into the frame buffer 10, per plane write mask 70 may be used to mask up to eight bits of a pixel byte that are not desired to be written. For example, if only four pixel bits are desired to be written into a pixel location in frame buffer 10, the per plane write mask 70 would mask four of the pixel bits at frame buffer 10, thereby preventing them from being written therein.

For purposes of illustration the specification herein has described the architecture as several separate devices coupled to a host CPU 50. However, it will be appreciated that the present invention may also be embodied as a single monolithic integrated chip which could be coupled directly to a host CPU. Also in the described embodiment of the present invention, VME bus 45 is 16 data bits wide, however, it will be appreciated that this is only one possible implementation and that other implementations may use wider data bus widths, denser DRAM chips, higher screen resolutions and other similar scalings of the described embodiment of the present invention.

Also, it will be appreciated that, although the improved memory organization of the present invention has, for illustrative purposes, been described as implemented in a graphics display system, the improved memory organization of the present invention may be also advantageously used in other digital computer systems and is not restricted to implementation in graphics systems.

The above described invention may be embodied, therefore, in other specific forms without departing from the spirit or essential characteristics thereof. The present embodiments are to be considered in all aspects as illustrative and unrestrictive, the scope of the invention being indicated by the appended claims rather than by the foregoing description, and all changes which come within the meaning and range of equivalency are, therefore, intended to be embraced therein.

What is claimed is:

1. An improved memory organization for use in a computer display system including a display having a plurality of display pixels for defining images, comprising:

a frame buffer memory having a plurality of selectively addressable memeory cells organized into a three-dimensional matrix, wherein each of said memory cells is adapted for storing a data bit defining selected characteristics of a corresponding display pixel and wherein said memory cells are relatable by a first bit organization oriented in a first plane of said matirx and a second bit organization orientied in a second plane of said matrix; said first and second bit organizations defining, respectively, first and second characteristics among said selected characteristics;

reading means coupled to said frame buffer memory for selectively reading, in one memory cycle operation, a plurality of bits from memory cells related by one of said bit organizations and defining one of said first or said second characteristics;

writing means coupled to said frame buffer memory for selectively writing, in one memory cycle operation, a plurality of bits into memory cells related by one of said bit organizations and defining one of said first or second characteristics;

control logic means coupled to said reading means and said writing means for generating control signals for controllably selecting one of said first and second bit organizations;

whereby image data may be conveniently organized in a single memory array for selective storage and retrieval in one of said first and second bit organizations so as to provide said selected characteristics of said pixels.

2. The improved memory organization as claimed in claim 1 wherein said matrix comprises:

a plurality of X-Y planes, each of said planes containing a plurality of memory cells, said memory cells of each plane having a one-to-one correspondence with said display pixels, wherein a first plurality of data units defining first display pixel characteristics are aligned along an X-axis and of said X-Y planes; and wherein said X-Y planes are aligned along a Z-axis such that a second plurality of data units defining second display pixel characteristics are aligned along said Z-axis.

3. The improved memory organization of claim 2 wherein said plurality of X-Y planes are consecutively aligned such that a first data bit on one plane corresponds to a second data bit on an adjacent plane such that said corresponding bits aligned along said Z-axis comprise one of said second plurality of data units.

4. The improved memory organization of claim 3 wherein said first plurality of data units and said second plurality of data units are stored within the same memory cells of said frame buffer.

5. The improved memory organization of claim 2 wherein said control logic means comprises:

a first address driver, coupled to said frame buffer, for issuing a first plurality of address signals to said frame buffer such that said first address driver issues a separate address for each of said first plurality of data units, thereby determining a memory location within a first predetermined segment of said frame buffer for each of said first plurality of data units;

a control logic device for issuing, in conjunction with said first plurality of address signals issued by said first address driver, a first plurality of frame buffer enabling signals to said frame buffer for enabling; said first predetermined segment of said frame buffer whereby, said first plurality of digital values are organized, such that a first map is defined within said frame.

6. The improved memory organization of claim 5 wherein said control logic means further comprises:

a second address driver, coupled to said frame buffer, for issuing a second plurality of address signals to said frame buffer such that said second address driver issues a separate address for each of said second plurality of data units, thereby determining a memory location within a second predetermined segment of said frame buffer for each of said second plurality of data units;

wherein said control logic device issues to said frame buffer, in conjunction with said second plurality of address signals issued by said second address driver, a second plurality of frame buffer enabling signals for enabling said second predetermined segment of said frame buffer.

7. The improved memory organization as claimed in claim 1 wherein said reading means comprises:

a first address driver, coupled to said frame buffer, for issuing a first plurality of address signals to said frame buffer such that said first address driver issues a separate address for each of said first plurality of data units, thereby determining a memory location within a first predetermined segment of said frame buffer for each of said first plurality of data units;

said control logic means issuing, in conjunction with said first plurality of address signals issued by said first address driver, a first plurality of frame buffer enabling signals to said frame buffer for enabling said first predetermined segment of said frame buffer;

a first memory logic means coupled to said frame buffer for receiving said first address signals and said first plurality of frame buffer enabling signals and retrieving said first plurality of data bytes in response thereto; and a first data driver coupled to said frame buffer for sensing and outputting a desired one of said first plurality of data units in conjunction with said first plurality of address signals and said first plurality of frame buffer enabling signals.

8. The improved memory organization as claimed in claim 7 wherein said reading means further comprises:

a second address driver, coupled to said frame buffer, for issuing a second plurality of address signals to said frame buffer such that said second address driver issues a separate address for each of said second plurality of data units, thereby determining a memory location within a second predetermined segment of said frame buffer for each of said second plurality of data units;

said control logic means issuing, in conjunction with said second plurality of address signals issued by said second address driver a second plurality of frame buffer enabling signals to said frame buffer for enabling said second predetermined segment of said frame buffer;

a second memory logic means coupled to said frame buffer for receiving said second address signals and said second plurality of frame buffer enabling signals and retrieving said second plurality of data units in response thereto; and a second data driver coupled to said frame buffer for sensing and outputting a desired one of said second plurality of data units in conjunction with said second plurality of address signals and said second plurality of frame buffer enabling signals.

9. The improved memory organization as claimed in claim 1 wherein said writing means comprises:

a first address driver, coupled to said frame buffer, for issuing a first plurality of address signals to said frame buffer such that said first address driver issues a separate address signal for each of said first plurality of data units, thereby determining a memory location within a first predetermined segment of said frame buffer for each of said first plurality of data units;

said control logic means issuing, in conjuntion with said first plurality of address signals issued by said first address driver, write enable signals and a first plurality of frame buffer enabling signals for enabling said first predetermined segment of said frame buffer and for permitting writing therein;

a first data driver coupled to said frame buffer for sensing and outputting a desired one of said first plurality of data units in conjunction with said first plurality of address signals;

wherein said first data driver writes a desired one of said first plurality of data units into said frame buffer at a memory location therein determined by said first plurality of address signals, said first plurality of frame buffer enabling signals and said write enable signals.

10. The improved memory organization of claim 9 wherein said writing means further comprises;

a second address driver coupled to said frame buffer, for issuing a second plurality of address signals to said frame buffer such that said second address driver issues a separate address signal for each of said second plurality of data units, thereby determining a memory location within a second predetermined segment of said frame buffer for each of said second plurality of data units;

said control logic means issuing, in conjunction with said second plurality of address signals issued by said second address driver, write enable signals and a second plurality of frame buffer enabling signals for enabling said second predetermined segment and for permitting writing therein;

a second data driver for sensing and outputting a desired one of said second plurality of data units in conjunction with said second plurality of address signals and said second plurality of frame buffer enabling signals;

wherein said second data driver writes a desired one of said second plurality of data units into said frame buffer at a memory location therein determined by said second plurality of address signals, said second plurality of frame buffer enabling signals and said write enable signals.

11. The improved memory organization of claim 1 wherein each data bit determines background/foreground of a corresponding one of said pixels.

12. The improved memory orgaization of claim 2 wherein said second plurality of data units determines a color at a corresponding one of said pixels.

13. The improved memory organization of claim 1 further comprising:

a raster logic processor, coupled between said reading means and said writing means for reading and writing a plurality of data bytes in alternate memory cycle operations.

14. The improved memory organization of claim 1 further comprising a per plane write mask coupled to said frame buffer, for masking a desired number of bits of a one of said second plurality of data bytes when said second plurality of data bytes are being written into said frame buffer.

15. The improved memory organization of claim 7 wherein said first data driver multiplexes said first plurality of data bytes.

16. The improved memory organization of claim 8 wherein said second data driver multiplexes said second plurality of data bytes.

17. The improved memory organization of claim 1 further comprising:

an optional frame buffer, coupled to said writing means, said reading means and said control logic means, wherein said optional frame buffer may be written to while said frame buffer is being read from and the reverse thereof.

18. An improved method of organizing a memory for use in a computer display system including a display having a plurality of display pixels for defining images, said method comprising the steps of:

organizing a frame buffer memory having a plurality of selectively addressable memory cells, wherein each of said memory cells is adapted for storing data defining selected characteristics, into a three-dimensional matrix such that said memory cells are relatable by a first bit organization, which is oriented in a first plane of said matrix and a second bit organization oriented in a second plane of said matrix; said first and second bit organizations defining, respectively, first and second characteristics among said selected characteristics;

corresponding the contents of said memory cells to said pixels;

coupling a reading means to said frame buffer for selectively reading, in one memory cycle operation, a plurality of bits from memory cells relatable by one of said bit orgaizations;

reading selectively said plurality of bits from one of said bit organizations from said frame buffer with said reading means;

coupling a writing means to said frame buffer memory, for selectively writing, in one memory cycle operation, a plurality of bits into memory cells relatable by one of said bit organizations;

writing selectively said plurality of bits from one of said bit organization to define a selected one of said characteristics into said frame buffer with said writing means;

coupling a control logic means to said reading means and said writing means and said frame buffer;

generating control signals for selecting one of said bit organizations to define said images to be displayed on said display.

19. The improved memory organization of claim 4, wherein said reading means, said writing means and said control logic means are comprised in a monolithic integrated circuit.

* * * * *

UNITED STATES PATENT AND TRADEMARK OFFICE

CERTIFICATE OF CORRECTION

PATENT NO. : 4,745,407

DATED : May 17, 1988

INVENTOR(S) : Costello

It is certified that errors appear in the above-identified patent and that said Letters Patent is hereby corrected as shown below:

In column 3, line 18, delete "specification" and insert -- Specification -- .

In column 11, line 61, delete "oolumn address" and insert -- column address -- .

In column 13, line 51, delete "said matirx" and insert -- said matrix -- .

In column 13, line 52, delete "orientied" and insert -- oriented -- .

In column 14, line 47, delete "whereby, said first plurality of digital values are organized, such that a first map is defined within said frame." and insert -- . -- .

In column 16, line 39, delete "orgaization" and insert -- organization -- .

Signed and Sealed this

Fifteenth Day of May, 2001

*Attest:*

Nicholas P. Godici

NICHOLAS P. GODICI

*Attesting Officer*

*Acting Director of the United States Patent and Trademark Office*